US010196906B2

(12) United States Patent
Lee et al.

(10) Patent No.: US 10,196,906 B2
(45) Date of Patent: Feb. 5, 2019

(54) TURBINE BLADE WITH A NON-CONSTRAINT FLOW TURNING GUIDE STRUCTURE

(71) Applicant: Siemens Energy, Inc., Orlando, FL (US)

(72) Inventors: Ching-Pang Lee, Cincinnati, OH (US); Yuekun Zhou, Charlotte, NC (US); Adhlere Coffy, Cincinnati, OH (US); Steven Koester, Toledo, OH (US)

(73) Assignee: SIEMENS ENERGY, INC., Orlando, FL (US)

( * ) Notice: Subject to any disclaimer, the term of this patent is extended or adjusted under 35 U.S.C. 154(b) by 0 days.

(21) Appl. No.: 15/552,327

(22) PCT Filed: Mar. 17, 2015

(86) PCT No.: PCT/US2015/020847

§ 371 (c)(1),
(2) Date: Aug. 21, 2017

(87) PCT Pub. No.: WO2016/148690

PCT Pub. Date: Sep. 22, 2016

(65) Prior Publication Data

US 2018/0038232 A1 Feb. 8, 2018

(51) Int. Cl.
*F01D 5/18* (2006.01)

(52) U.S. Cl.
CPC ..... *F01D 5/187* (2013.01); *F05D 2250/185* (2013.01); *F05D 2260/22141* (2013.01); *F05D 2260/607* (2013.01)

(58) Field of Classification Search
CPC . F01D 5/147; F01D 5/18; F01D 5/186; F01D 5/187; F05D 2250/185; F05D 2260/22141
See application file for complete search history.

(56) References Cited

U.S. PATENT DOCUMENTS 4,474,532 A 10/1984 Pazder
4,786,233 A * 11/1988 Shizuya ..... F01D 5/187 416/90 R (Continued)

FOREIGN PATENT DOCUMENTS

EP 1223308 A2 7/2002
EP 1519008 A1 3/2005

(Continued)

OTHER PUBLICATIONS

PCT International Search Report and Written Opinion dated Dec. 18, 2015 corresponding to PCT Application PCT/US2015/020847 filed Mar. 17, 2015.

*Primary Examiner* — Carlos A Rivera
*Assistant Examiner* — Sang K Kim

(57) ABSTRACT

A turbine blade including a pressure sidewall (24) and a suction sidewall (26), and at least one partition rib (34) extends between the pressure and suction sidewalls (24, 26) to define a serpentine cooling path (35) having adjacent cooling channels (36*a*, 36*b*, 36*c*) extending in the spanwise direction (S) within the airfoil (12). A flow turning guide structure (50) extends around an end of the at least one partition rib (34) and includes a first element (52) extending from the pressure sidewall (24) to a lateral location in the cooling path between the pressure and suction sidewalls (24, 26), a second element (54) extending from the suction sidewall (26) to the lateral location in the cooling path between the pressure and suction sidewalls (24, 26). The first and second elements (52, 54) include respective distal edges ($\mathbf{52}_d$, $\mathbf{54}_d$) that laterally overlap each other at the lateral location.

9 Claims, 5 Drawing Sheets

(56) References Cited

U.S. PATENT DOCUMENTS

| | | | |
|---|---|---|---|
| 5,403,159 | A | 4/1995 | Green et al. |
| 5,498,126 | A | 3/1996 | Pighetti et al. |
| 6,257,830 | B1 | 7/2001 | Matsuura et al. |
| 6,347,923 | B1 | 2/2002 | Semmler et al. |
| 6,595,750 | B2 | 7/2003 | Parneix et al. |
| 6,939,102 | B2 | 9/2005 | Liang |
| 7,118,325 | B2 | 10/2006 | Kvasnak et al. |
| 7,137,784 | B2 | 11/2006 | Hall et al. |
| 7,217,097 | B2 | 5/2007 | Liang |
| 7,413,403 | B2 | 8/2008 | Cunha et al. |
| 7,950,903 | B1 | 5/2011 | Liang |
| 8,016,563 | B1 | 9/2011 | Liang |
| 2002/0176776 | A1 | 11/2002 | Parneix et al. |
| 2005/0069414 | A1 | 3/2005 | Liang |
| 2005/0276698 | A1 | 12/2005 | Kvasnak et al. |

FOREIGN PATENT DOCUMENTS

| | | | |
|---|---|---|---|
| EP | 2489838 | A2 | 8/2012 |
| JP | H04232304 | A | 8/1992 |

* cited by examiner

TURBINE BLADE WITH A NON-CONSTRAINT FLOW TURNING GUIDE STRUCTURE

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

This invention is directed generally to turbine blades and, more particularly, to a turbine blade having a cooling circuit for conducting cooling air through an airfoil of the blade.

BACKGROUND OF THE INVENTION

A conventional gas turbine engine includes a compressor, a combustor and a turbine. The compressor compresses ambient air which is supplied to the combustor where the compressed air is combined with a fuel and ignites the mixture, creating combustion products forming a hot working gas. The working gas is supplied to the turbine where the gas passes through a plurality of paired rows of stationary vanes and rotating blades. The rotating blades are coupled to a shaft and disc assembly. As the working gas expands through the turbine, the working gas causes the blades, and therefore the shaft and disc assembly, to rotate.

As a result of the exposure of the turbine blades to the hot working gases, the turbine blades must be made of materials capable of withstanding such high temperatures. In addition, turbine blades often contain cooling systems for prolonging the life of the blades and reducing the likelihood of failure as a result of excessive temperatures.

Typically, turbine blades comprise a root, a platform and an airfoil that extends outwardly from the platform. The airfoil is ordinarily composed of a tip, a leading edge and a trailing edge. Most blades typically contain internal cooling channels forming a cooling system. The cooling channels in the blades may receive cooling air from the compressor of the turbine engine and pass the air through the blade.

SUMMARY OF THE INVENTION

In accordance with an aspect of the invention, a turbine blade is provided comprising an airfoil including an outer wall extending spanwise between a blade platform and a blade tip. The outer wall includes a pressure sidewall and a suction sidewall, and the pressure and suction sidewalls are joined together at chordally spaced apart leading and trailing edges of the airfoil. At least one partition rib extends between the pressure and suction sidewalls to define a serpentine cooling path having adjacent cooling channels extending in the spanwise direction between the blade platform and the blade tip. A flow turning guide structure extends around an end of the at least one partition rib between each of the adjacent cooling channels. The flow turning guide structure includes a first element extending from the pressure sidewall to a lateral location in the cooling path between the pressure and suction sidewalls, a second element extending from the suction sidewall to the lateral location in the cooling path between the pressure and suction sidewalls, wherein the first and second elements include respective distal edges that laterally overlap each other at the lateral location.

The flow turning guide structure can include a central portion radially aligned with the at least one partition rib, and a radial gap may be defined between the first and second elements at the central portion.

A ratio of lateral overlap to the radial gap between the first and second elements may be within a range of 25% to 100%.

The central portion can comprise an arcuate shape.

The flow turning guide structure can include end portions at opposing ends of the central portion wherein the end portions may be aligned with respective ones of the adjacent channels.

The first and second elements can be chordally spaced from each other to define a chordal gap along a spanwise portion of each of the end portions.

The location in the cooling path where the first and second elements laterally overlap may be a mid-way location between the pressure and suction sidewalls.

The at least one partition rib may be a first partition rib separating a first cooling channel adjacent to the leading edge from a second cooling channel downstream from the first cooling channel, and the flow turning guide structure may be located between a radially outer end of the first partition rib and the blade tip.

A second partition rib may be provided separating the second cooling channel from a third cooling channel downstream from the second cooling channel, and a further flow turning guide structure may be provided extending around a radially inner end of the second partition rib, wherein the second flow turning guide structure may comprise a third element extending from the pressure sidewall to a second lateral location in the cooling path between the pressure and suction sidewalls, a fourth element extending from the suction sidewall to the second lateral location in the cooling path between the pressure and suction sidewalls, wherein the third and fourth elements include respective distal edges that laterally overlap each other at the second lateral location.

The second flow turning guide structure can include an arcuate central portion having end portions aligned with respective ones of the second and third cooling channels, and wherein an end portion aligned with the third cooling channel may extend through the third cooling channel at least about 30% of a span height of the airfoil.

In accordance with another aspect of the invention, a turbine blade is provided comprising an airfoil including an outer wall extending spanwise between a blade platform and a blade tip. The outer wall includes a pressure sidewall and a suction sidewall, and the pressure and suction sidewalls are joined together at chordally spaced apart leading and trailing edges of the airfoil. At least one partition rib extends between the pressure and suction sidewalls to define a serpentine cooling path having adjacent cooling channels extending in the spanwise direction between the blade platform and the blade tip. A flow turning guide structure extends around an end of the at least one partition rib to guide cooling fluid flow from one cooling channel to another cooling channel. The flow turning guide structure includes first and second elements extending toward each other from the pressure and suction sidewalls, respectively, wherein a combined lateral height of the first and second elements is greater than a width of the flow path between the pressure and suction sidewalls at a corresponding location of the elements.

A length of the flow turning guide structure may extend along a direction of cooling fluid flow through the flow path and pass around the end of the at least one partition rib, and a gap between the first and second elements may be defined transverse to both the lateral height direction and the cooling fluid flow direction.

The first and second elements can include respective distal edges that overlap each other in the lateral height direction along the length of the flow turning guide structure.

A ratio of lateral overlap to the gap between the first and second elements may be within a range of 25% to 100%.

The distal edges of the first and second elements may overlap at a mid-way location between the pressure and suction sidewalls.

The flow turning guide structure can include an arcuate central portion radially aligned with the at least one partition rib, and the first element may be displaced radially relative to the second element to define a radial gap between the first and second elements at the central portion.

The flow turning guide structure can includes end portions at opposing ends of the central portion wherein the end portions may be aligned with respective ones of the adjacent channels.

The first and second elements can be chordally spaced from each other to define a chordal gap along a spanwise portion of each of the end portions.

In accordance with a further aspect of the invention, an air cooled turbine blade is provided comprising an airfoil including an outer wall extending spanwise between a blade platform and a blade tip. The outer wall includes a pressure sidewall and a suction sidewall, and the pressure and suction sidewalls are joined together at chordally spaced apart leading and trailing edges of the airfoil. At least one partition rib extends between the pressure and suction sidewalls to define a serpentine cooling path having adjacent cooling channels extending in the spanwise direction between the blade platform and the blade tip. A flow turning guide structure extends around an end of the at least one partition rib to guide cooling fluid flow from one cooling channel to another cooling channel. The flow turning guide structure includes first and second elements extending toward each other in a lateral height direction from the pressure and suction sidewalls, respectively. The first and second elements define an arcuate central portion of the flow guide structure radially aligned with the at least one partition rib, wherein the first element is displaced radially relative to the second element to define a radial gap between the first and second elements at the central portion, and the first and second elements define end portions at opposing ends of the central portion wherein the end portions are aligned with respective ones of the adjacent channels.

A length of the flow turning guide structure may extend along a direction of cooling fluid flow through the flow path and passing around the end of the at least one partition rib, and the first and second elements can include respective distal edges that overlap each other in the lateral height direction along the length of the flow turning guide structure.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
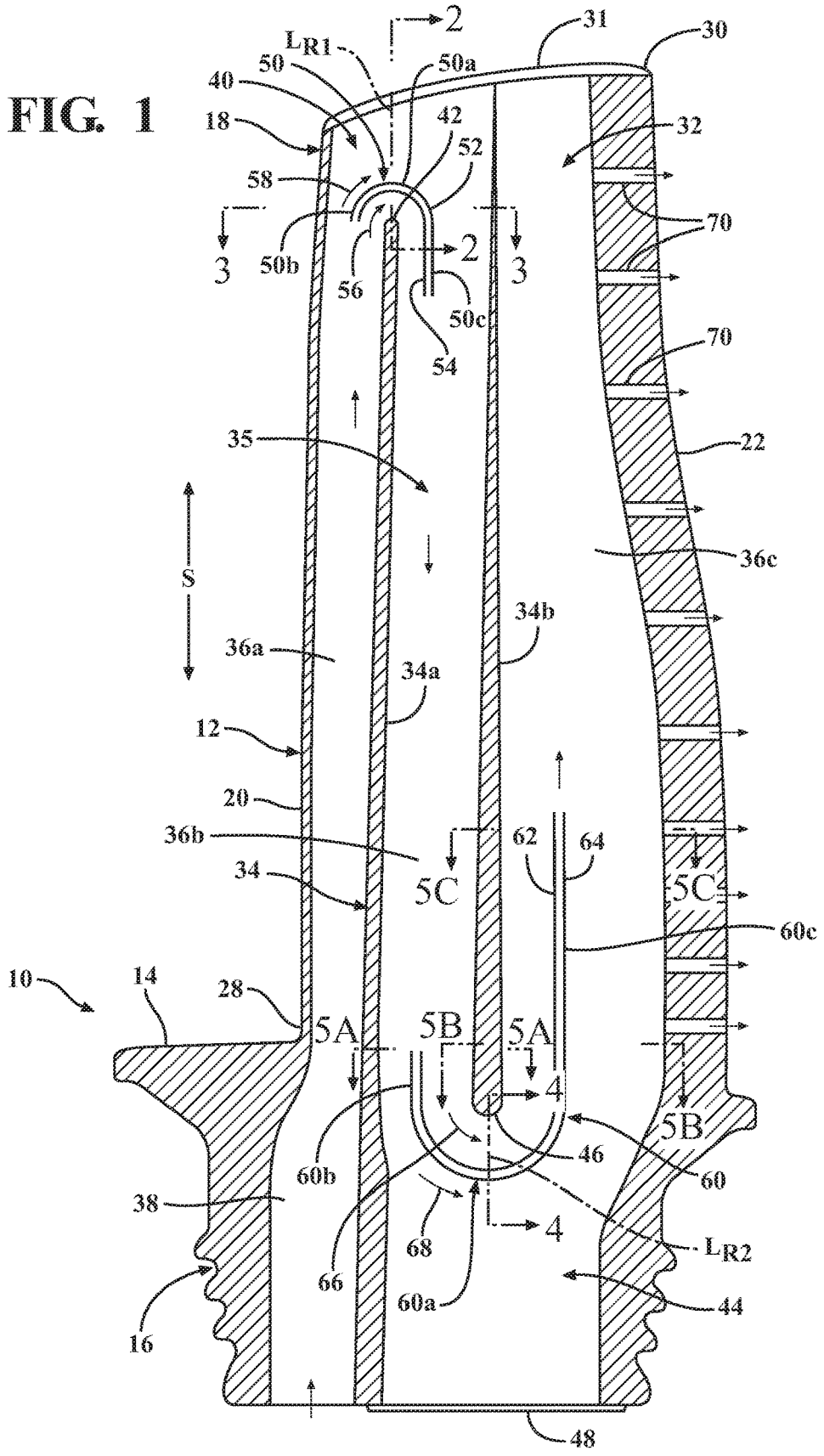
FIG. 1 is an elevational cross-sectional view, taken along a chordal axis in an axial plane, illustrating aspects of the present invention.
Figure 2:
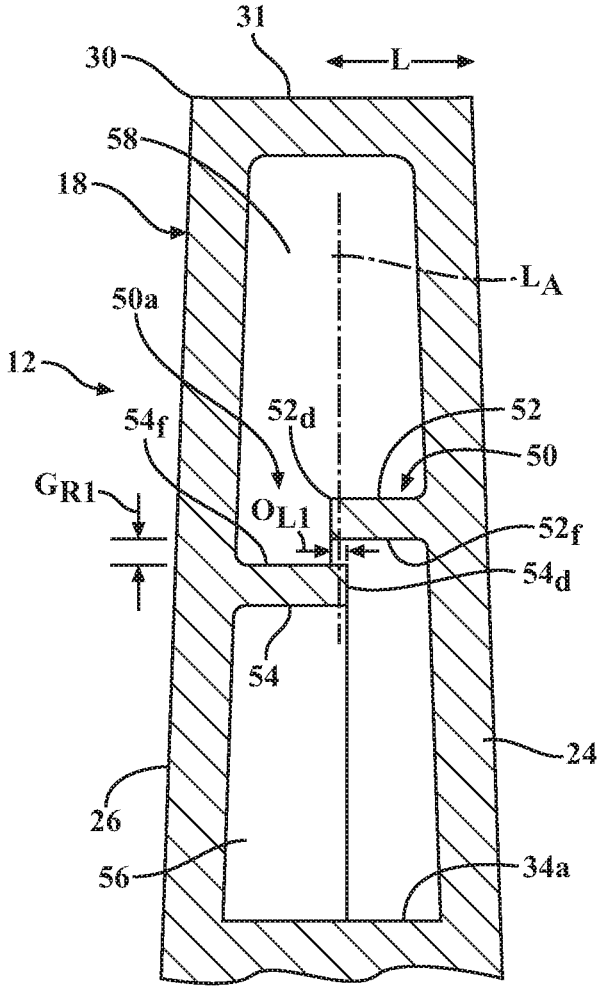
FIG. 2 is a cross-sectional view taken along line 2-2 in FIG. 1.
Figure 3:
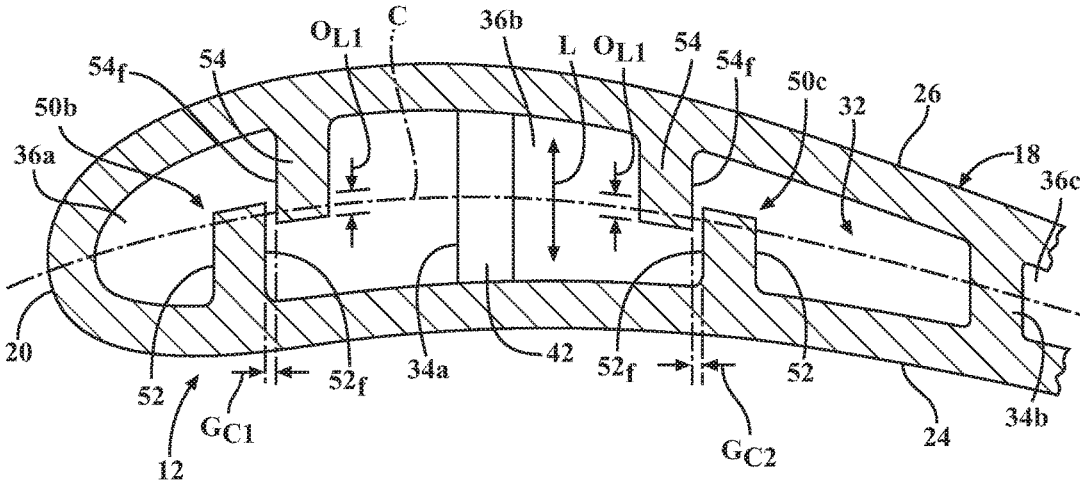
FIG. 3 is a cross-sectional view taken along line 3-3 in FIG. 1.

The present invention provides a construction for an airfoil, such as may be located within a turbine section of a gas turbine engine (not shown). As used throughout, unless otherwise noted, the terms "radially inner," "radially outer," "span" and derivatives thereof are used with reference to a longitudinal or spanwise axis of the airfoil 12 represented by arrow S in FIG. 1; the term "chordal" and derivatives thereof is used with reference to a chordal line C of the airfoil 12, as depicted in FIG. 3; the term "lateral" and derivatives thereof is used with reference to a lateral line L extending perpendicular to the spanwise axis S and the chordal line C, as depicted in FIG. 2; and the terms "axial," "upstream," "downstream," and derivatives thereof are used with reference to a flow of combustion gases through the hot gas path in the turbine section. Referring now to FIGS. 1 and 3, an exemplary airfoil assembly 10 constructed in accordance with an aspect of the present invention is illustrated. The airfoil assembly 10 includes an airfoil 12, a blade platform 14, and a root 16 that is used to conventionally secure the airfoil assembly 10 to the shaft and disc assembly of the turbine section (not shown) for supporting the airfoil assembly 10 in the gas flow path of the turbine section. The airfoil 12 includes an outer wall 18 extending in a radial or spanwise direction S between the blade platform 14 and a blade tip 30. Further, the airfoil outer wall 18 defines a leading edge 20, a trailing edge 22, a pressure sidewall 24, a suction sidewall 26, a radially inner end 28 adjacent to the platform 14, and the radially outer tip 30. The radially outer tip 30 comprises a tip wall 31 extending laterally between the pressure and suction sidewalls 24, 26 (see FIG. 2).

With reference to FIG. 1, the leading and trailing edges 20, 22 are spaced axially or chordally from each other with respect to a chordal direction C (FIG. 3), and the pressure and suction sidewalls 24, 26 are spaced laterally from each other with respect to a lateral line L to define a main airfoil cavity 32. The airfoil 12 may further comprise at least one partition rib 34, and depicted in the illustrated embodiment as a plurality of partition ribs comprising first and second partition ribs 34*a* and 34*b* extending laterally through the main airfoil cavity 32 between the pressure and suction sidewalls 24, 26 (FIG. 3) and extending radially between the radially inner end 28 and the radially outer tip 30 (FIG. 1). Each of the partition ribs 34*a*, 34*b* separate adjacent cooling channels into successive adjacent cooling channels extending in the downstream direction, e.g., successive respective first and second cooling channels are separated by at least one partition rib 34*a*, 34*b*. In the illustrated embodiment, the first partition rib 34*a* extends from a location within the blade root 16 to a radially outer end 42 spaced from the tip wall 31, and the second partition rib 34*b* extends from the tip wall 31 to a location radially inward of the platform 14 adjacent to the radially inner end 28 of the outer wall 18.

The plurality of partition ribs 34*a*, 34*b* define cooling channels arranged to form a serpentine cooling path 35 within the main airfoil cavity 32. In particular, a first or leading edge cooling channel 36*a* is defined between the leading edge 20 and the first partition rib 34*a*, a second or mid-chord cooling channel 36*b* is defined between the first partition rib 34*a* and the second partition rib 34*b*, and a third or trailing edge cooling channel 36*c* is defined between the second partition rib 34*b* and the trailing edge 22. Cooling fluid flow may be introduced through a root cooling fluid supply passage 38 and flow radially outward through the leading edge channel 36*a* toward the blade tip 30, where the cooling fluid flow direction changes in an outer region 40 between the blade tip 30 and the outer end 42 of the first partition rib 34*a*. The cooling fluid then flows radially inward through the mid-chord cooling channel 36*b* to an inner region 44 between the inner end 46 of the second partition rib 34*b* and the blade root 16 where the cooling fluid flow direction again changes and flows radially outward through the trailing edge cooling channel 36*c*. Subsequently, the cooling fluid can flow out of the main airfoil cavity 32 through a plurality of trailing edge slots 70.

It may be noted that, although the illustrated embodiment of the airfoil 12 depicts two partition ribs 34*a*, 34*b* and three cooling fluid channels 36*a-c*, a fewer or greater number of ribs and cooling channels may be provided within the spirit and scope of the present invention. Further, the blade root 16 may be provided with additional cooling fluid supply passages, such as one or more fluid supply passages supplying a supplemental flow of cooling fluid at the location of the plate 48 (FIG. 1) covering a portion of the radial inner end of the blade root 16.

Referring to FIGS. 1-3, an aspect of the airfoil 12 includes an outer flow turning guide structure 50 to facilitate turning of cooling fluid flow in the outer region 40 where the cooling fluid flow direction reverses from radially outward to radially inward. The guide structure 50 extends laterally through the main airfoil cavity 32 between the pressure and suction sidewalls 24, 26, and extends around the outer end 42 of the first partition rib 34*a*, extending chordally between each of the adjacent leading edge and mid-chord cooling channels 36*a*, 36*b*.

As seen in FIG. 1, the guide structure 50 includes an arcuate central portion 50*a* radially aligned with the first partition rib 34*a* and extending to either side of the first partition rib 34*a*. The guide structure 50 further includes end portions extending from either axial end of the central portion 50*a*, and can include a first end portion 50*b* radially aligned with the leading edge cooling channel 36*a* and a second end portion 50*c* radially aligned with the mid-chord cooling channel 36*b*. The end portions 50*b*, 50*c* form terminal ends of the guide structure 50 extending along a spanwise extent of the guide structure 50 and defining end surfaces for directing fluid flow and that may be aligned or generally aligned parallel to the spanwise axis S. The central portion 50*a* may comprise at least the portion of the guide structure 50 that is radially intersected by an imaginary radial line extension $L_{R1}$ of the first partition rib 34*a*, and can include at least arcuate surfaces of the guide structure 50 having tangent lines that extend at an angle of between 90 degrees and 45 degrees relative to the spanwise axis S.

Referring to FIG. 2, the flow turning guide structure 50 includes a first element 52 extending from an interior surface of the pressure sidewall 24 to a lateral location $L_A$ in the cooling path 35 between the pressure and suction sidewalls 24, 26, and a second element 54 extending from an interior surface of the suction sidewall 26 to the lateral location $L_A$ in the cooling path 35 between the pressure and suction sidewalls 24, 26. The lateral location $L_A$ may be understood as being located generally centrally (mid-way) between the pressure and suction sidewalls 24, 26, and may be more particularly understood as including locations defined by intersections of the chordal line C and the spanwise axis S.

Figure 2A:
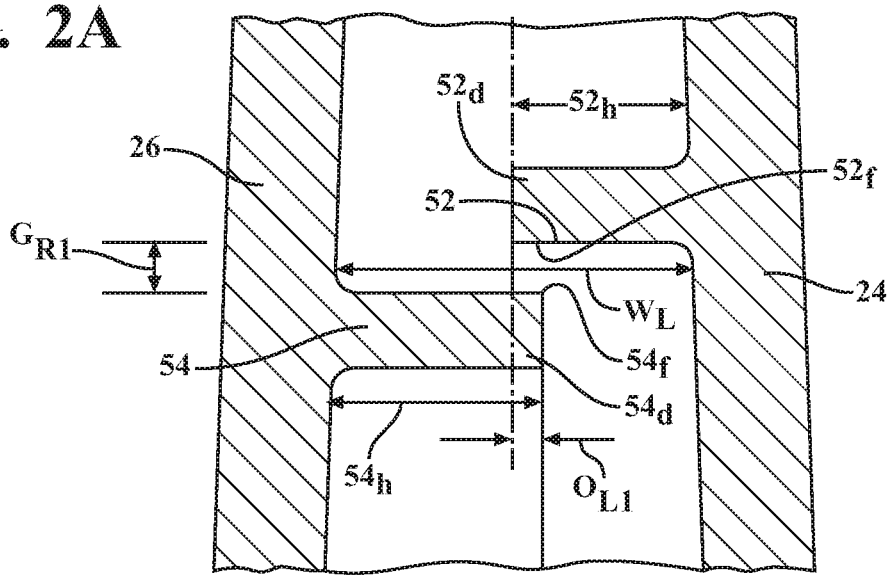
FIG. 2A is an enlarged view of a portion of the guide structure shown in FIG. 2.

Referring to FIG. 2A, each of the first and second elements 52, 54 defines a lateral height $\mathbf{52}_h$, $\mathbf{54}_h$, respectively. A combined lateral height ($\mathbf{52}_h$+$\mathbf{54}_h$) of the first and second elements 52, 54 is greater than the lateral width $W_L$ of the flow path 35 defined by the lateral distance between the pressure and suction sidewalls 24, 26 at the corresponding location of the first and second elements 52, 54, i.e., at the lateral height location of the first and second elements 52, 54. Further, as illustrated herein, the first element 52 is displaced outwardly from the second element 54 along the length of a loop formed by the guide structure 50 and separated by a radial/chordal gap, as is described in further detail below. The first and second elements 52, 54 include respective distal edges $\mathbf{52}_d$, $\mathbf{54}_d$ that laterally overlap each other at the lateral location $L_A$. That is, the first and second elements 52, 54 define respective surfaces $\mathbf{52}_f$, $\mathbf{54}_f$ that face each other and overlap each other in the lateral height direction in the area defining the distal edges $\mathbf{52}_d$, $\mathbf{54}_d$. For example, a lateral overlap $O_{L1}$ is defined by the overlapping distal edges $\mathbf{52}_d$, $\mathbf{54}_d$.

As noted above, the first and second elements 52, 54 are separated by a radial/chordal gap that comprises a predetermined or limited gap, illustrated as a radial gap $G_{R1}$ in FIG. 2 and as chordal gaps $G_{C1}$ and $G_{C2}$ in FIG. 3. It may be understood that the radial/chordal gap between the first and second elements 52, 54 is a continuous gap extending along the length of the guide structure 50, and having components in both the radial (spanwise) and chordal directions extending along a plane parallel to a plane defined by the intersection of the chordal line C and the spanwise axis S. The radial/chordal gap includes the specifically described gap locations $G_{R1}$, $G_{C1}$, $G_{C2}$, where either the chordal or the radial component may be at a minimum. The predetermined or limited gap can be described by a ratio $R_1$ of the lateral overlap $O_{L1}$ to the radial/chordal gap between the first and second elements 52, 54, e.g., the gap described for locations $G_{R1}$, $G_{C1}$, $G_{C2}$, wherein the ratio $R_1$ is preferably within the range of 25% to 100%. It may be understood that the ratio $R_1$ can be constant along the length of the guide structure 50, or either or both of the overlap $O_{L1}$ and radial/chordal gap (e.g., $G_{R1}$, $G_{C1}$, $G_{C2}$) can be varied to vary the ratio $R_1$. In an exemplary embodiment of the guide structure 50, the overlap $O_{L1}$ may be 1.0 mm and the radial/chordal gap ($G_{R1}$, $G_{C1}$, $G_{C2}$) may be 2.0 mm to define a ratio $R_1$ of 50%.

The flow turning guide structure 50 directs or guides the cooling fluid flow through the 180 degree turn around the outer end 42 of the first partition rib 34*a*. The guide structure 50 separates the cooling fluid flow into inner and outer turn paths 56 and 58 as the flow passes around the outer end 42 of the first partition rib 34*a* to reduce recirculation flow at the outer region 40 for better heat transfer distribution. That is, all of the radial outward flow of cooling fluid in the inner turn path 56 contacts a radially inward facing surface of either the first element 52 or the second element 54 to induce a change of direction of the flow, reducing the radial outward momentum of the cooling fluid flow and redirecting the flow inward toward the downstream mid-chord channel 36*b*. Further, the split construction of the guide structure 50, including separate first and second elements 52, 54 with overlapping edges $\mathbf{52}_d$, $\mathbf{54}_d$, avoids formation of a mechanical constraint between the pressure and suction sidewalls 24, 26 while constricting or resisting flow of cooling fluid between the inner and outer turn paths 56, 58. The resistance to flow though the radial/chordal gap provided by the overlapping distal edges $\mathbf{52}_d$, $\mathbf{54}_d$ maintains the thermal advantages of providing a flow guide, in a manner substantially similar to that of a laterally continuous flow guide extending the full width of the flow path, while eliminating a mechanical constraint and corresponding stresses associated with a laterally continuous flow guide.

Referring to FIGS. 4 and 5A-C, a second or inner flow turning guide structure 60 is illustrated, located adjacent to the radially inner end 28 of the airfoil outer wall 18. The flow turning guide structure 60 defines a further guide structure that facilitates turning of the cooling fluid flow in the inner region 44 where the cooling fluid flow direction reverses from radially inward to radially outward. The inner guide structure 60 can be constructed in accordance with the same structural aspects as described with reference to the outer guide structure 50, and extends laterally through the main airfoil cavity 32 between the pressure and suction sidewalls 24, 26. The inner guide structure 60 extends around the inner end 46 of the second partition rib 34*b*, extending chordally between each of the adjacent mid-chord and trailing edge cooling channels 36*b*, 36*c*.

As seen in FIG. 1, the guide structure 60 includes an arcuate central portion 60*a* radially aligned with the second partition rib 34*b* and extending to either side of the second partition rib 34*b*. The guide structure 60 further includes end portions extending from either axial end of the central portion 60*a*, and can include a first end portion 60*b* radially aligned with the mid-chord cooling channel 36*b* and a second end portion 60*c* radially aligned with the trailing edge cooling channel 36*c*. The end portions 60*b*, 60*c* form terminal ends of the guide structure 60 extending along a spanwise extent of the guide structure 60 and defining end surfaces for directing fluid flow and that may be aligned or generally aligned parallel to the spanwise axis S. The central portion 60*a* may comprise at least the portion of the guide structure 60 that is radially intersected by an imaginary radial line extension $L_{R2}$ of the second partition rib 34*b*, and can include at least arcuate surfaces of the guide structure 60 having tangent lines that extend at an angle of between 90 degrees and 45 degrees relative to the spanwise axis S.

The guide structure 60 directs or guides the cooling fluid flow through the 180 degree turn around the inner end 46 of the second partition rib 34*b*. The guide structure 60 separates the cooling fluid flow into inner and outer turn paths 66 and 68 the flow passes around the inner end 46 of the second partition rib 34*b* to reduce recirculation flow at the inner region 44 for better heat transfer distribution. Further, as noted above, cooling air can exit the trailing edge channel 36*c* along the trailing edge slots 70 that may be located along the length of the trailing edge 22, and the end portion 60*c* can provide a divider to guide the flow in the inner turn path 66 to a radial outer location of the trailing edge channel 36*c* before it can exit via the trailing edge slots 70. For example, the end portion 60*c* can extend within the trailing edge channel 36*c* at least about 30% of a span height of the airfoil 12 to guide a portion of the cooling air flow to a radially outer portion of the airfoil 12.

Figure 4:
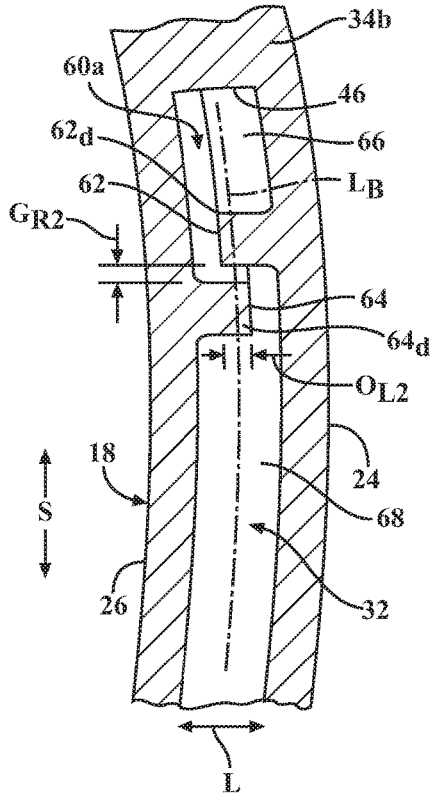
FIG. 4 is a cross-sectional view taken along line 4-4 in FIG. 1.
Figure 5A:
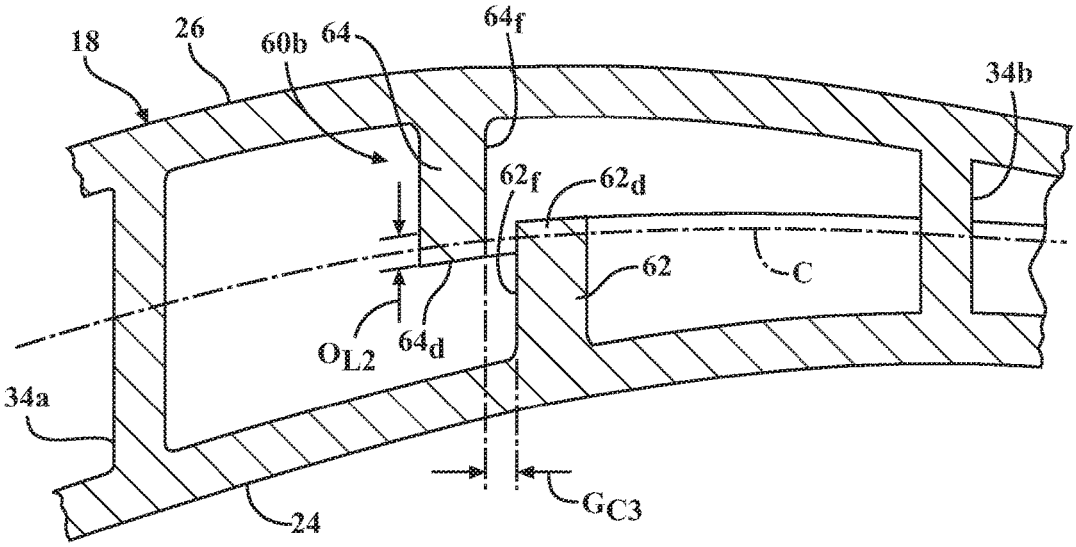
FIG. 5A is a cross-sectional view taken along line 5A-5A in FIG. 1.
Figure 5B:
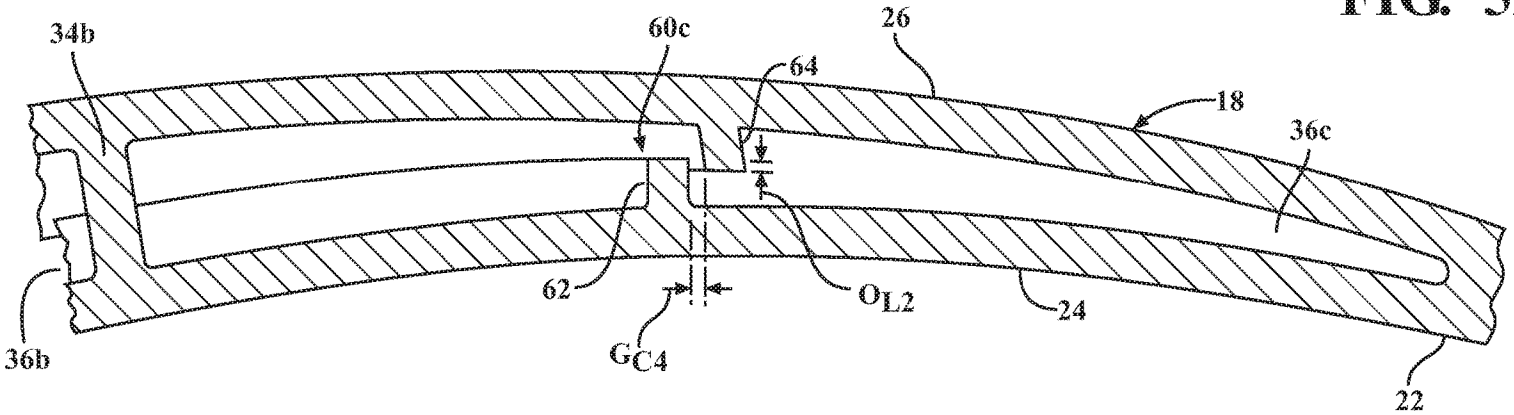
FIG. 5B is a cross-sectional view taken along line 5B-5B in FIG. 1.
Figure 5C:
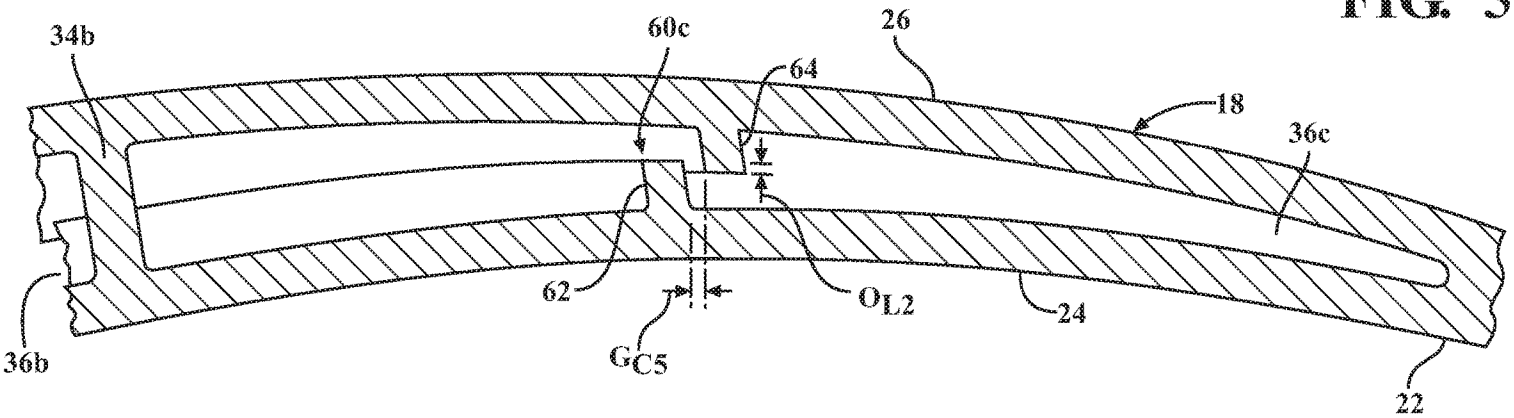
FIG. 5C is a cross-sectional view taken along line 5C-5C in FIG. 1.

Referring to FIGS. 5A-C, the flow turning guide structure 60 includes a third element 62 extending from an interior surface of the pressure sidewall 24 to a lateral location $L_B$ (FIG. 4) in the cooling path 35 between the pressure and suction sidewalls 24, 26, and a fourth element 64 extending from the suction sidewall 26 to the lateral location $L_B$ in the cooling path 35 between the pressure and suction sidewalls 24, 26. The lateral location $L_B$ may be understood as being located generally centrally (mid-way) between the pressure and suction sidewalls 24, 26, and may be more particularly understood as including locations defined by intersections of the chordal line C and the spanwise axis S.

Similar to the structure described for the outer guide structure 50, a combined lateral height of the third and fourth elements 62, 64 is greater than the width of the flow path 35 defined by the lateral distance between the pressure and suction sidewalls 24, 26 at the corresponding location of the third and fourth elements 62, 64, i.e., at the lateral height location of the third and fourth elements 62, 64. Further, as illustrated herein, the third element 62 is displaced outwardly from the fourth element 64, i.e., closer to the second partition rib 34*b*, along the length of a loop formed by the guide structure 60 and separated by a radial/chordal gap, as is described in further detail below. The third and fourth elements 62, 64 include respective distal edges $\mathbf{62}_d$, $\mathbf{64}_d$ that laterally overlap each other at the lateral location $L_B$. That is, the third and fourth elements 62, 64 define respective surfaces $\mathbf{62}_f$, $\mathbf{64}_f$ (FIG. 5A) that face each other and overlap each other in the lateral height direction in the area defining the distal edges $\mathbf{62}_d$, $\mathbf{64}_d$. For example, a lateral overlap $O_{L2}$ is defined by the overlapping distal edges $\mathbf{62}_d$, $\mathbf{64}_d$.

As noted above, third and fourth elements 62, 64 are separated by a radial/chordal gap that comprises a predetermined or limited gap, illustrated as a radial gap $G_{R2}$ in FIG. 4 and as chordal gaps $G_{C3}$, $G_{C4}$ and $G_{C5}$ in FIGS. 5A, 5B and 5C, respectively. It may be understood that the radial/chordal gap between the third and fourth elements 62, 64 is a continuous gap extending along the length of the guide structure 60, and having components in both the radial (spanwise) and chordal directions extending along a plane parallel to a plane defined by the intersection of the chordal line C and the spanwise axis S. It may be understood that the radial/chordal gap includes the specifically described gap locations $G_{R2}$, $G_{C3}$, $G_{C4}$ and $G_{C5}$, where either the chordal or the radial component may be at a minimum. The predetermined or limited gap can be described by a ratio $R_2$ of the lateral overlap $O_{L2}$ to the radial/chordal gap between the third and fourth elements 62, 64, e.g., the gap described for locations $G_{R2}$, $G_{C3}$, $G_{C4}$, $G_{C5}$, wherein the ratio $R_2$ is preferably within the range of 25% to 100%. It may be understood that the ratio $R_2$ can be constant along the length of the guide structure 60, or either or both of the overlap $O_{L2}$ and radial/chordal gap (e.g., $G_{R2}$, $G_{C3}$, $G_{C4}$, $G_{C5}$) can be varied to vary the ratio $R_2$.

Similar to the operation of the outer guide structure 50, the radial inward flow of cooling fluid in the inner turn path 66 contacts a radially outwardly facing surface of either the third element 62 or the fourth element 64 to induce a change of direction of the flow, i.e., to reduce the radial inward momentum of the cooling fluid flow and redirecting the flow outward toward the downstream trailing edge channel 36*c*. Further, the split construction of the inner guide structure 60, including separate third and fourth elements 62, 64, with overlapping edges $62_d$, $64_d$ avoids formation of a mechanical constraint between the pressure and suction sidewalls 24, 26 while resisting flow of cooling fluid between the inner and outer turn paths 66, 68.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine blade comprising:

an airfoil including an outer wall extending spanwise between a blade platform and a blade tip, the outer wall including a pressure sidewall and a suction sidewall, the pressure and suction sidewalls joined together at chordally spaced apart leading and trailing edges of the airfoil;

at least one partition rib extending between the pressure and suction sidewalls to define a serpentine cooling path having adjacent cooling channels extending in the spanwise direction between the blade platform and the blade tip;

a flow turning guide structure extending around an end of the at least one partition rib between each of the adjacent cooling channels, the flow turning guide structure including:

a first element extending from the pressure sidewall to a lateral location in the cooling path between the pressure and suction sidewalls;

a second element extending from the suction sidewall to the lateral location in the cooling path between the pressure and suction sidewalls;

wherein the first and second elements include respective distal portions that laterally overlap each other at the lateral location, wherein the flow turning guide structure include a central portion radially aligned with the at least one partition rib, and a radial gap is defined between the first and second elements at the central portion.

2. The turbine blade of claim 1, wherein a ratio of lateral overlap to the radial gap between the first and second elements is within a range of 25% to 100%.

3. The turbine blade of claim 1, wherein the central portion comprises an arcuate shape.

4. The turbine blade of claim 1, wherein the flow turning guide structure includes end portions at opposing ends of the central portion wherein the end portions are aligned with respective ones of the adjacent channels.

5. The turbine blade of claim 3, wherein the first and second elements are chordally spaced from each other to define a chordal gap along a spanwise portion of each of the end portions.

6. The turbine blade of claim 1, wherein the location in the cooling path where the first and second elements laterally overlap is a mid-way location between the pressure and suction sidewalls.

7. The turbine blade of claim 1, wherein the at least one partition rib is a first partition rib separating a first cooling channel adjacent to the leading edge from a second cooling channel downstream from the first cooling channel, and the flow turning guide structure is located between a radially outer end of the first partition rib and the blade tip.

8. The turbine blade of claim 7, including a second partition rib separating the second cooling channel from a third cooling channel downstream from the second cooling channel, and including a further flow turning guide structure extending around a radially inner end of the second partition rib, wherein the second flow turning guide structure comprises:

a third element extending from the pressure sidewall to a second lateral location in the cooling path between the pressure and suction sidewalls;

a fourth element extending from the suction sidewall to the second lateral location in the cooling path between the pressure and suction sidewalls;

wherein the third and fourth elements include respective distal that laterally overlap each other at the second lateral location.

9. The turbine blade of claim 8, wherein the second flow turning guide structure includes an arcuate central portion having end portions aligned with respective ones of the second and third cooling channels, and wherein an end portion aligned with the third cooling channel extends through the third cooling channel at least about 30% of a span height of the airfoil.

* * * * *